US009755384B2

(12) United States Patent
Bury et al.

(10) Patent No.: US 9,755,384 B2
(45) Date of Patent: Sep. 5, 2017

(54) BRIDGING MODULE HAVING A HOUSING WITH A LATCHING DEVICE FOR LATCHING TO A MOUNTING RAIL

(71) Applicant: Phoenix Contact GmbH & Co KG, Blomberg (DE)

(72) Inventors: Joachim Bury, Herford (DE); Thomas Salomon, Verl (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 15/033,611

(22) PCT Filed: Nov. 3, 2014

(86) PCT No.: PCT/EP2014/073566
§ 371 (c)(1),
(2) Date: Apr. 29, 2016

(87) PCT Pub. No.: WO2015/063297
PCT Pub. Date: May 7, 2015

(65) Prior Publication Data

US 2016/0285216 A1 Sep. 29, 2016

(30) Foreign Application Priority Data

Nov. 4, 2013 (DE) ..... 10 2013 112 115

(51) Int. Cl.
*H01R 9/26* (2006.01)
*H01R 25/00* (2006.01)
(Continued)

(52) U.S. Cl.
CPC ..... *H01R 25/006* (2013.01); *H01R 9/26* (2013.01); *H01R 9/2608* (2013.01);
(Continued)

(58) Field of Classification Search
CPC ..... H01R 4/64; H01R 9/26; H01R 9/2608; H01R 13/62; H01R 13/6271;
(Continued)

(56) References Cited

U.S. PATENT DOCUMENTS 4,878,859 A * 11/1989 Haller ..... H01R 9/2608 439/716
5,362,259 A * 11/1994 Bolliger ..... H01R 9/2691 439/532
(Continued)

FOREIGN PATENT DOCUMENTS

DE 3633785 A1 4/1988
DE 4402002 A1 7/1995
(Continued)

*Primary Examiner* — Chandrika Prasad
(74) *Attorney, Agent, or Firm* — Knobbe, Martens, Olson & Bear, LLP

(57) ABSTRACT

The present invention relates to a bridging module (300) for electrically connecting a functional component of a component assembly system, said bridging module comprising a module housing (337) which has an interlocking device (301) for detachably and interlockingly holding the bridging module (300) on a profiled mounting rail.

14 Claims, 13 Drawing Sheets

(51) Int. Cl.
*H01R 13/506* (2006.01)
*H01R 13/514* (2006.01)
*H01R 13/52* (2006.01)
*H01R 27/02* (2006.01)

(52) U.S. Cl.
CPC ..... *H01R 13/506* (2013.01); *H01R 13/514* (2013.01); *H01R 13/5202* (2013.01); *H01R 13/5208* (2013.01); *H01R 13/5219* (2013.01); *H01R 27/02* (2013.01)

(58) Field of Classification Search
CPC ..... H01R 13/5202; H01R 13/5219; H01R 13/62955; H01R 25/14; H01R 25/142; H01R 9/2691; H01R 13/506; H01R 13/514; H01R 13/5208; H01R 27/02; H05K 7/026; H05K 7/10; H05K 7/206; H05K 7/1401; H05K 7/1441; H05K 7/1474; H05K 7/1477; H05K 7/1478; H05K 7/1465
USPC ..... 439/271, 351, 352, 532, 533, 716; 361/601, 622, 801, 810
See application file for complete search history.

(56) References Cited

U.S. PATENT DOCUMENTS 5,480,310 A * 1/1996 Baum ..... H01R 9/2691 439/716
6,053,198 A 4/2000 Atkin et al.
6,224,429 B1 * 5/2001 Bernhards ..... H01R 9/2608 439/709
6,226,762 B1 * 5/2001 Foote ..... H04B 1/74 709/224
6,371,435 B1 * 4/2002 Landis ..... H02B 1/052 248/694
6,704,815 B1 * 3/2004 Morikawa ..... H01R 9/2675 700/19
8,715,017 B1 * 5/2014 Barber ..... H01R 9/2408 439/716
8,834,194 B2 * 9/2014 Sakai ..... F21V 29/22 439/345
9,039,460 B2 * 5/2015 Hackemack ..... H01R 9/16 439/716
2002/0072266 A1 * 6/2002 Lange ..... H01R 9/26 439/358
2007/0173136 A1 * 7/2007 Bentler ..... H01R 9/2491 439/835
2009/0068901 A1 * 3/2009 Nad ..... H01R 9/26 439/716
2009/0194652 A1 * 8/2009 Bury ..... H02B 1/21 248/222.11
2011/0059658 A1 * 3/2011 Eisert ..... H01R 9/2625 439/716
2014/0113503 A1 * 4/2014 Barber ..... H01R 9/2408 439/712
2016/0278228 A1 * 9/2016 Bury ..... H01R 11/03
2016/0285216 A1 * 9/2016 Bury ..... H01R 9/26
2016/0286674 A1 * 9/2016 Bury ..... H05K 7/1441
2016/0286679 A1 * 9/2016 Bury ..... H05K 7/1465
2016/0330869 A1 * 11/2016 Williams ..... H05K 7/20472

FOREIGN PATENT DOCUMENTS

DE 19816170 C2 10/2002
DE 102005025703 A1 12/2006
DE 102005028735 B4 7/2008
DE 202010006065 U1 9/2010
DE 202011105337 U1 1/2012
DE 102010044201 A1 5/2012
EP 1079465 A2 2/2001

* cited by examiner

BRIDGING MODULE HAVING A HOUSING WITH A LATCHING DEVICE FOR LATCHING TO A MOUNTING RAIL

The present invention relates to a bridging module for electrically connecting a functional component of a component assembly system.

Modern component assembly systems from automation technology typically comprise a multiplicity of functional components which are arranged in a switch cabinet. The distributor functions for power and data are implemented with separate plug-in systems. A structure without a switch cabinet is not possible, since peripheral devices close to the switch cabinet hang with a star-like power distribution system. If, for example, use is made of field bus concepts, in which individual components are placed on back plates, high weight forces are exerted on the back plates. Housings for electrical appliances are generally made in one piece or two pieces. A combination with further housings is made via wiring or interfaces in an extension direction.

The object on which the invention is based is to specify a bridging module for electrically and mechanically connecting functional components which can be mounted in a simple way.

This object is achieved by the subject matter having the features as claimed in the independent claim. Advantageous embodiments of the invention are the subject matter of the figures, the description and the dependent claims.

According to one aspect of the invention, the object is achieved by a bridging module for electrically connecting a functional component of a component assembly system, comprising a module housing which has a form-fitting device for holding the bridging module on a profiled mounting rail in a detachable and form-fitting manner. This achieves the technical advantage, for example, that the mounting of the bridging module is accelerated and simplified.

The component assembly system can be a field bus system.

According to one embodiment, the form-fitting device is configured so as to secure the bridging module on the profiled mounting rail only against lifting but not against displacement of the bridging module along the profiled mounting rail. As a result, for example, thermal expansion of the bridging module can be taken into account.

In an advantageous embodiment of the bridging module, the form-fitting device is configured so as to hold the bridging module on the profiled mounting rail only in a form-fitting manner.

In an advantageous embodiment of the bridging module, the form-fitting device is configured so as to at least partly enclose the profiled mounting rail in a form-fitting manner, or to partly engage around the same or to partly engage behind the same.

In an advantageous embodiment of the bridging module, the form-fitting device comprises or is a latching device for latching the bridging module onto a profiled mounting rail.

In an advantageous embodiment of the bridging module, the form-fitting device comprises at least one bolt, in particular a pivotable bolt or a sliding bolt, or a latching slider for engaging underneath the profiled mounting rail.

In an advantageous embodiment of the bridging module, the module housing is assembled from a lower module housing part and an upper module housing part. This achieves the technical advantage, for example, that the bridging module can be assembled in modular fashion from different basic components, in order in this way to achieve a different functionality, depending on the upper module housing part that is used.

In a further advantageous embodiment of the bridging module, a sealing element is arranged between the lower module housing part and the upper module housing part. This achieves the technical advantage, for example, that penetration of moisture is prevented.

In a further advantageous embodiment of the bridging module, the module housing comprises at least one electric plug-in section to be plugged into a cut-out in the functional component. This achieves the technical advantage, for example, that a reliable electrical and mechanical connection between the bridging module and the functional component is produced.

In a further advantageous embodiment of the bridging module, the plug-in section comprises a sealing element for sealing the plug-in section with respect to the cut-out in the functional component. This achieves the technical advantage, for example, that penetration of moisture into the plug-in section is prevented.

In a further advantageous embodiment of the bridging module, the bridging module comprises a first electric plug-in section for a first functional component and a second electric plug-in section for a second functional component. This achieves the technical advantage, for example, that in each case a functional component can be placed on one of two sides of the bridging module.

In a further advantageous embodiment of the bridging module, the first electric plug-in section and the second electric plug-in section are connected electrically to at least one bow-shaped bridging plug. This achieves the technical advantage, for example, that the electricity or signals of the field bus can be led on to another functional component by the bridging module.

In a further advantageous embodiment of the bridging module, the module housing comprises a box-shaped cable receiving section for the insertion of an electric cable, for example a power and/or data cable. This achieves the technical advantage, for example, that the electric cable can be inserted into an otherwise flat bridging module.

In a further advantageous embodiment of the bridging module, the cable receiving section comprises an internal thread for a sealing screw for the electric cable to be screwed in. This achieves the technical advantage, for example, that penetration of moisture into the module housing is prevented.

In a further advantageous embodiment of the bridging module, the bridging module comprises a dovetail cut-out for the insertion of a dovetail section of a fixed bearing module. This achieves the likewise technical advantage, for example, that tensile forces from the functional component are transferred efficiently to the bridging module.

In a further advantageous embodiment of the bridging module, the bridging module comprises at least one receiving groove for the insertion of an insert section of a functional component, in order to absorb tensile forces from the functional component along the profiled mounting rail. This achieves the technical advantage, for example, that damage to the plug-in contacts by tensile forces is prevented.

In a further advantageous embodiment of the bridging module, the bridging module comprises a first receiving groove on a first module housing side and a second receiving groove on an opposite module housing side. This achieves the technical advantage, for example, that the tensile forces from the functional component can be transferred to the bridging module efficiently and in a torque-free manner on two sides.

In a further advantageous embodiment of the bridging module, the form-fitting device comprises a resilient latching section to engage laterally over the profiled mounting rail. This achieves the technical advantage, for example, that the latching means can engage on the rear side of the profiled mounting rail, and a stable connection is produced.

In a further advantageous embodiment of the bridging module, the latching section comprises a latching lug to engage behind the profiled mounting rail. This achieves the technical advantage, for example, that the bridging module is latched onto the rear side of the profiled mounting rail and fixed in a straightforward manner.

In a further advantageous embodiment of the bridging module, the latching section is formed in one piece on the module housing. This achieves the technical advantage, for example, that the bridging module can be produced with the latching means in one operation.

Exemplary embodiments of the invention are illustrated in the drawings and will be described in more detail below.

Figure 1A:
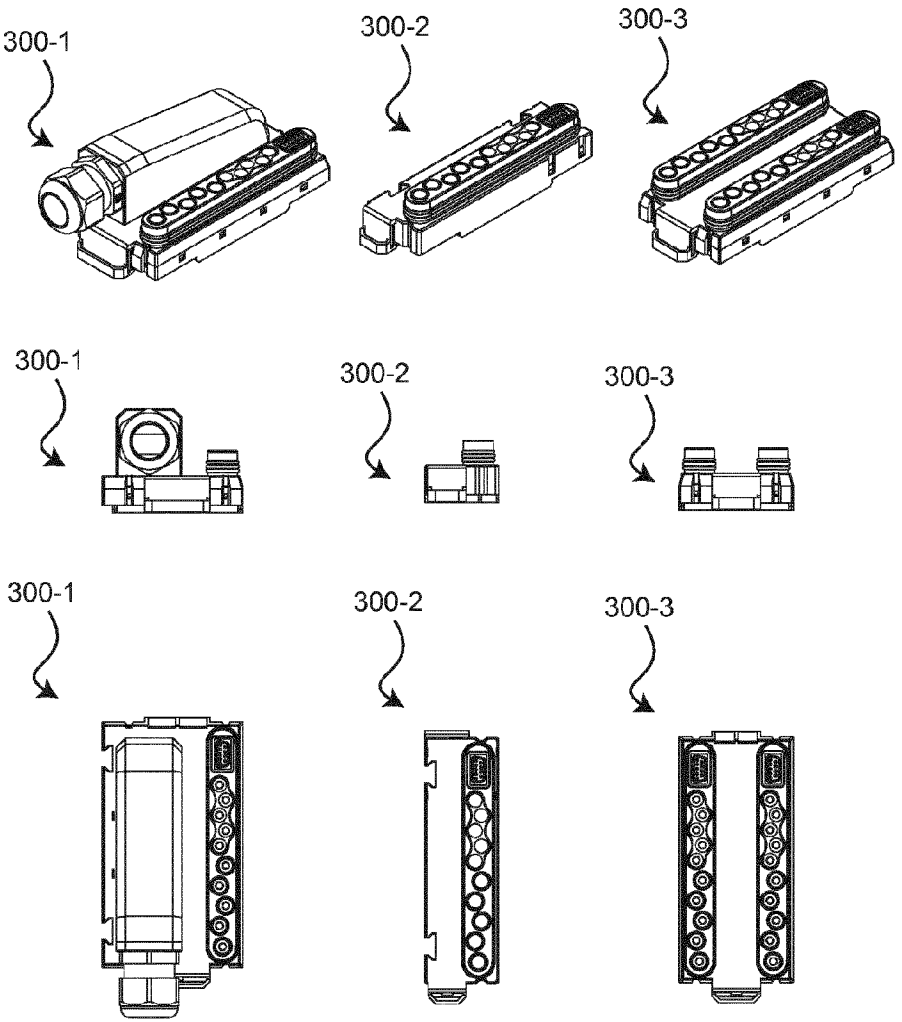
FIG. 1A shows different views of different bridging modules.
Figure 1B:
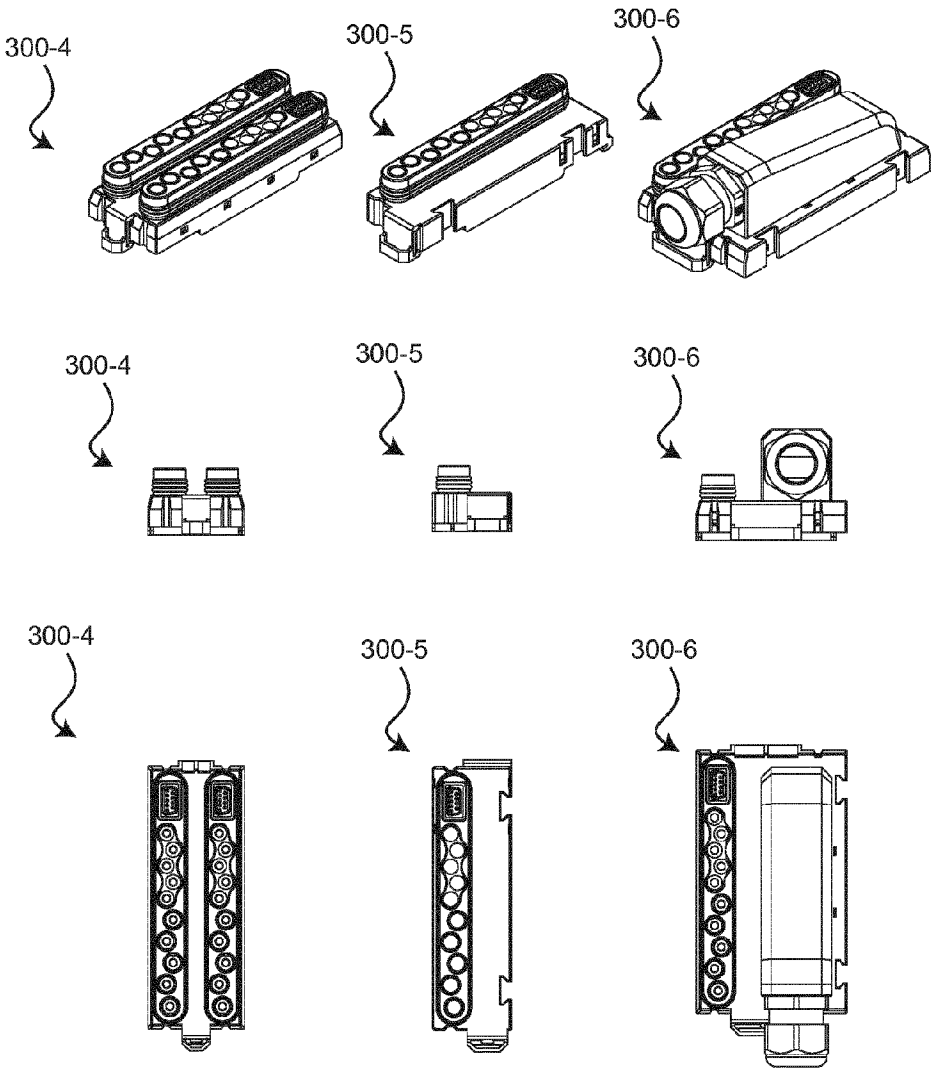
FIG. 1B shows different views of different bridging modules.

FIGS. 1A and 1B show different views of different bridging modules 300-1 to 300-6. The bridging modules 300-1 to 300-6 are used for electrically and mechanically connecting functional components of a component assembly system. The bridging modules 300-1 to 300-6 comprise plug-in contacts and a form-fitting device for latching the bridging modules 300-1 to 300-6 on a profiled mounting rail as the bridging module 300 is put in place. The bridging modules 300-1 to 300-6 are freely displaceable along the profiled mounting rail following the form-fitting connection, for example latching.

The bridging modules 300-1 to 300-6 can be implemented with different widths, so that the distance between joined functional components is determined by the bridging modules 300-1 to 300-6. This distance can define a ventilation chimney between the functional components.

Figure 2A:
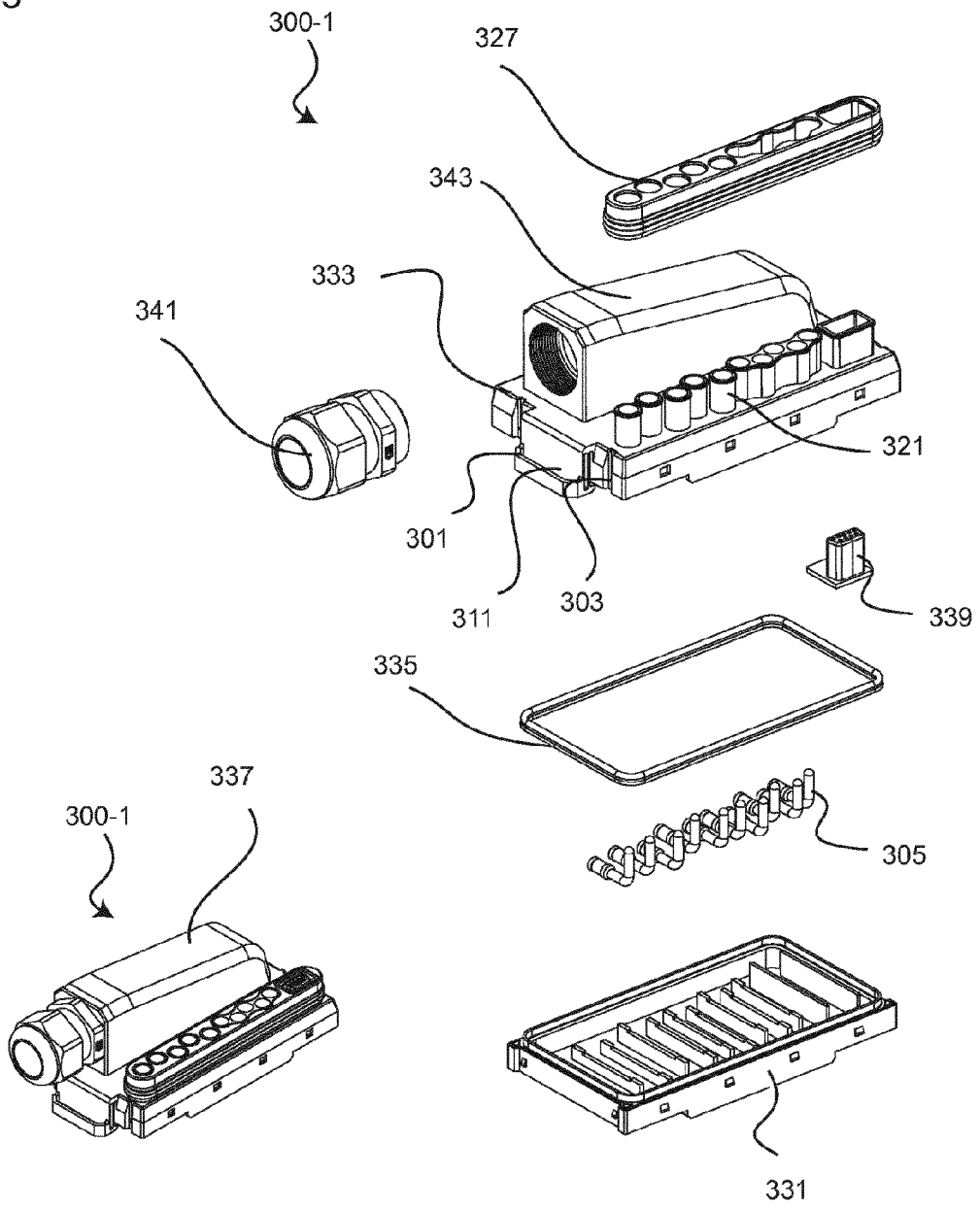
FIG. 2A shows an exploded view of a first bridging module.
Figure 2B:
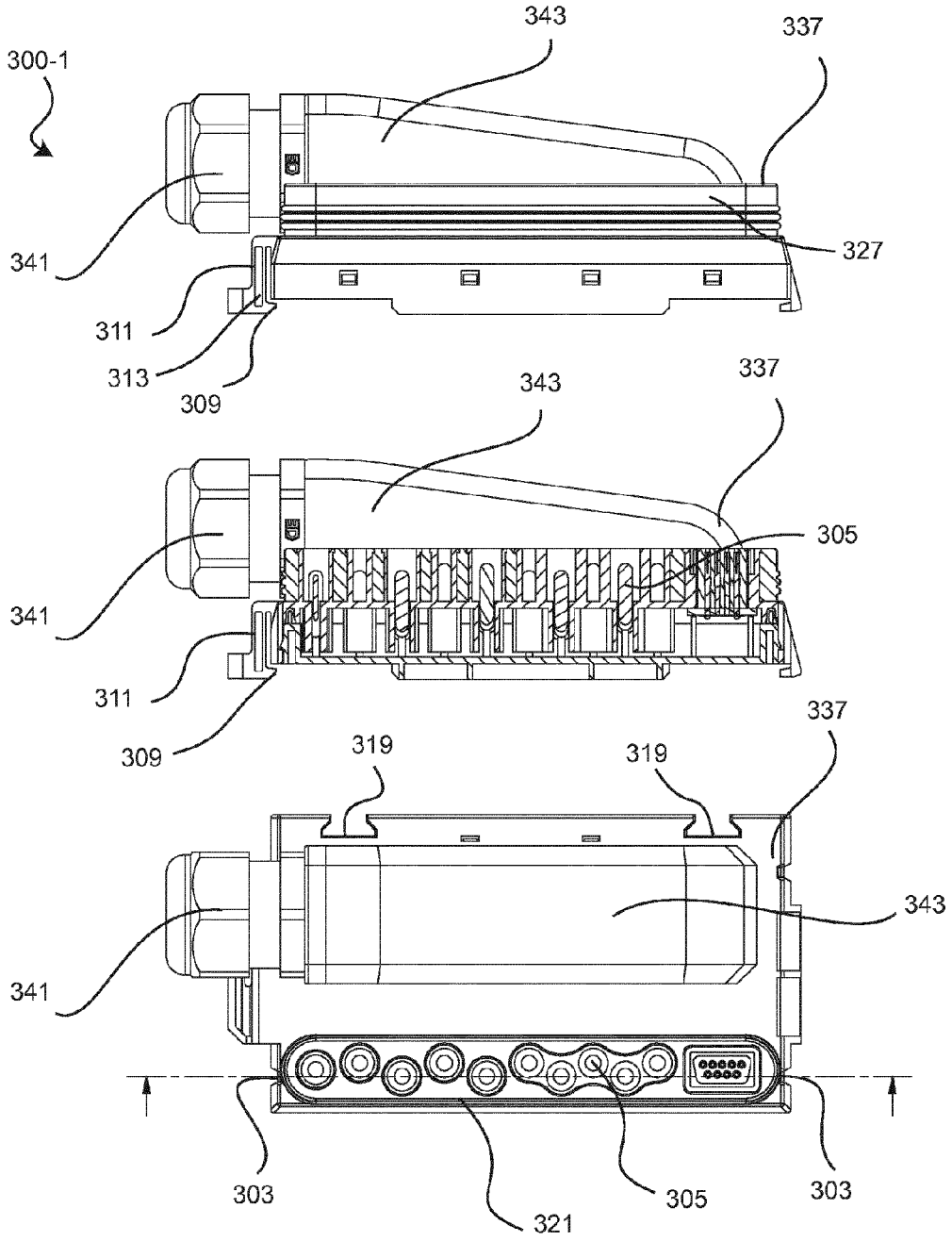
FIG. 2B shows different views of the first bridging module.

FIG. 2A shows an exploded view of a first bridging module 300-1, and FIG. 2B shows further different views of the first bridging module 300-1. The bridging module 300-1 comprises a module housing 337, which is assembled from a lower module housing part 331 and an upper module housing part 333. Module housing connection is carried out by means of latching, screwing, pressing, welding or adhesive bonding. Between the lower module housing part 331 and the upper module housing part 333 there is arranged a sealing element 335, which is clamped in between the two module housing parts 331 and 333.

The electrical structure of the bridging module 300-1 provides connections for extra-low and low voltages. For this purpose, conductors or plugs made of bent round wire or as punched and shaped parts or as bus bars made of punched sheet metal with contacted connector pins are provided in the interior of the bridging module 300.

For a data bus connection, a data bus plug 339 is provided on a passive and/or active circuit board. Located in the interior of the module housing 337 are electric bridging plugs 305 for making contact with an electric plug-in section 321.

The plug-in section 321 projects out of the module housing 337 and has a plug-in face. The plug-in section 321 is inserted into a corresponding cut-out in a functional component which is placed on the plug-in section 321. The plug-in section 321 comprises a circumferential sealing element 327, so that a sealing system for the functional component plugged on is produced.

On the transverse sides, the bridging module 300-1 respectively comprises a receiving groove 303 for the insertion of an insert section of a functional component, in order to absorb tensile forces from the functional component along the profiled mounting rail. By means of the insert section of the functional component and the receiving groove 303, a form-fitting connection is produced between the functional component and the bridging module 300-1. As a result, the plug-in sections 321 can be relieved of load in the event of tensile forces.

In addition, the bridging module 300-1 comprises a form-fitting device 301 for the form-fitting connection, for example latching, of the bridging module 300-1 with the profiled mounting rail.

The form-fitting device 301 according to one embodiment is formed by a resilient latching section 311 which, following the placement of the bridging module 300-1, engages laterally over the profiled mounting rail. The latching section 311 comprises an elongated recess 313 along the latching section 311, so that the flexibility of the latching section 311 is increased. As a result, the bridging module 300-1 can be formed in one piece from a solid plastic without the latching section 311 having an excessively high strength. Located at the end of the latching section 311 is a latching lug 309, such as a plastic latching hook, which, following the placement of the bridging module 300-1, engages behind the profiled mounting rail 200.

The upper module housing part 333 comprises a box-shaped cable receiving section 343 having an opening for the lateral insertion of an electric cable. Arranged in the opening is an internal thread for a sealing screw 341 for the electric cable to be screwed in. In addition, the bridging module 300-1 comprises a dovetail cut-out 319 for the insertion of a dovetail section of a fixed bearing module.

Figure 3A:
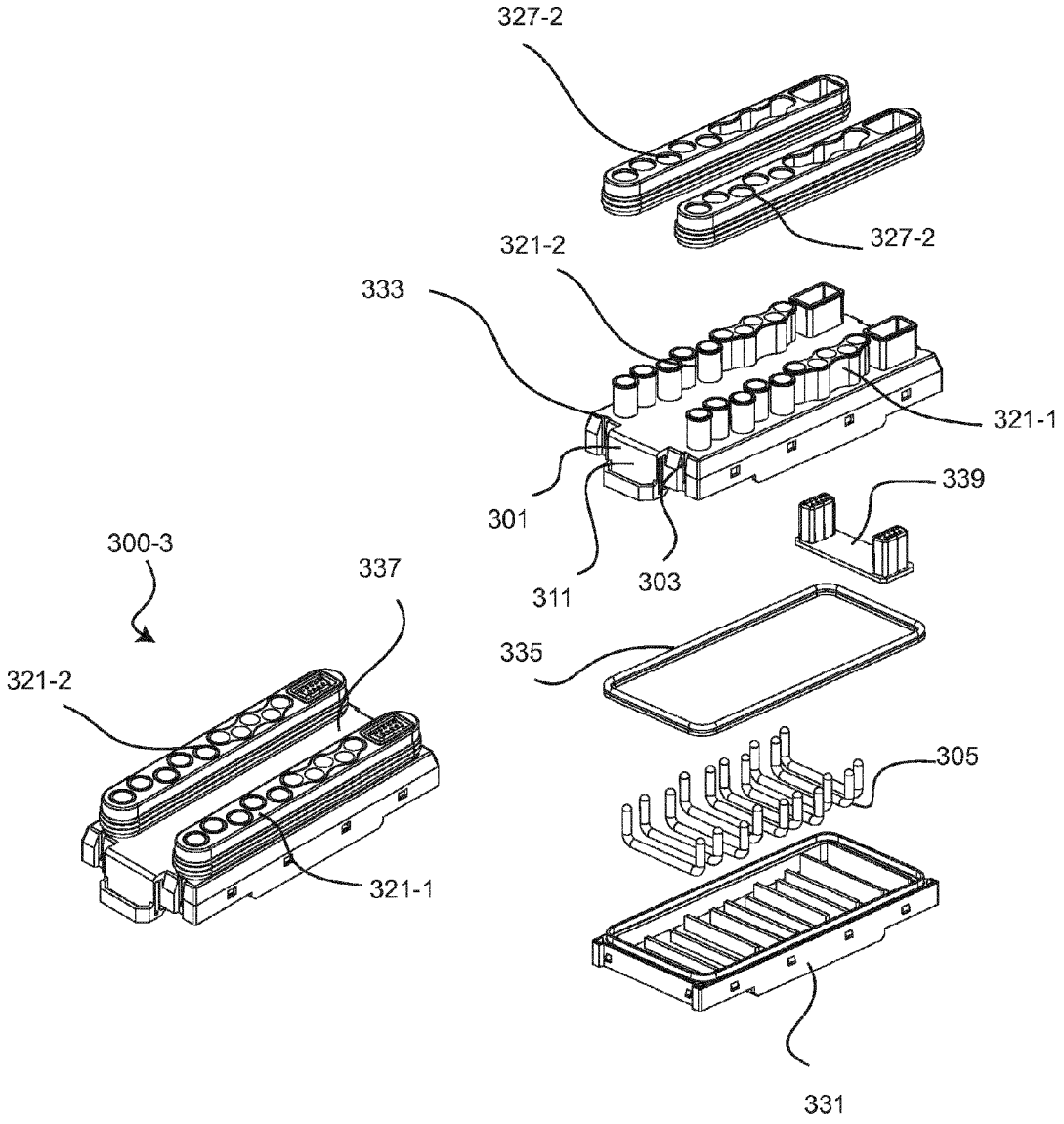
FIG. 3A shows an exploded view of a second bridging module.
Figure 3B:
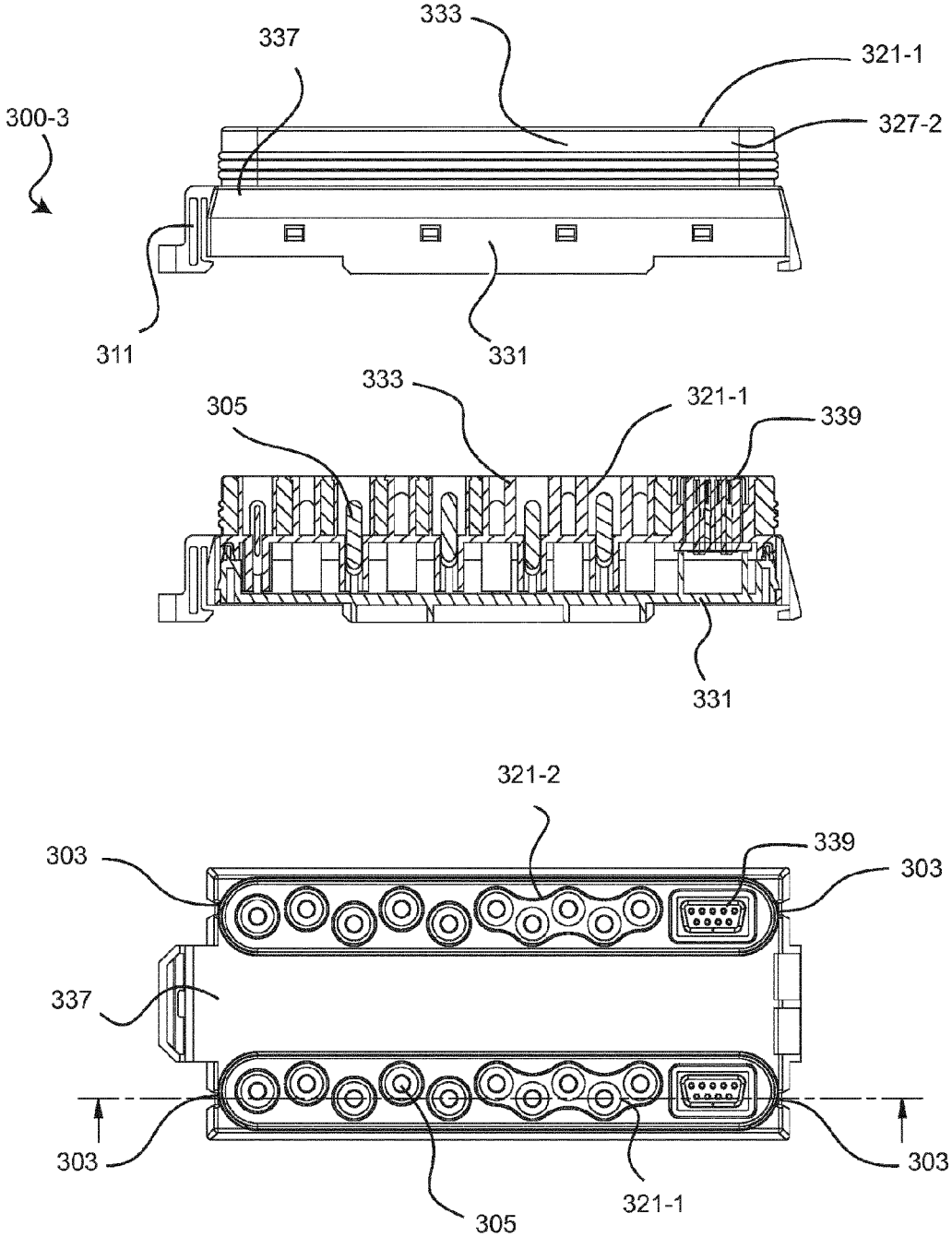
FIG. 3B shows different views of the second bridging module.

FIG. 3A shows an exploded view of a second bridging module 300-3, and FIG. 3B shows different views of the second bridging module 300-3. The second bridging module 300-3 is likewise assembled from a module housing 337 with the lower module housing part 331 and the upper module housing part 333. The upper module housing part 333 comprises a first and a second plug-in section 321-1 and 321-2. The first electric plug-in section 321-1 is used for the placement of a first functional component, and the second electric plug-in section 321-2 is used for the placement of a second functional component. Located in the interior of the module housing 337 are U-shaped electric bridging plugs 305 to make contact with the electric plug-in sections 321-1 and 321-2. The plug-in sections 321-1 and 321-2 of the bridging module 300-3 are spaced apart in order to produce clearances between the functional components.

On the transverse sides, the bridging module 300-5 respectively comprises two receiving grooves 303 for the insertion of an insert section of a right-side or left-side functional component, in order to absorb tensile forces from the functional component along the profiled mounting rail. Otherwise, the bridging module 300-3 corresponds to that from FIGS. 2A and 2B.

Figure 4A:
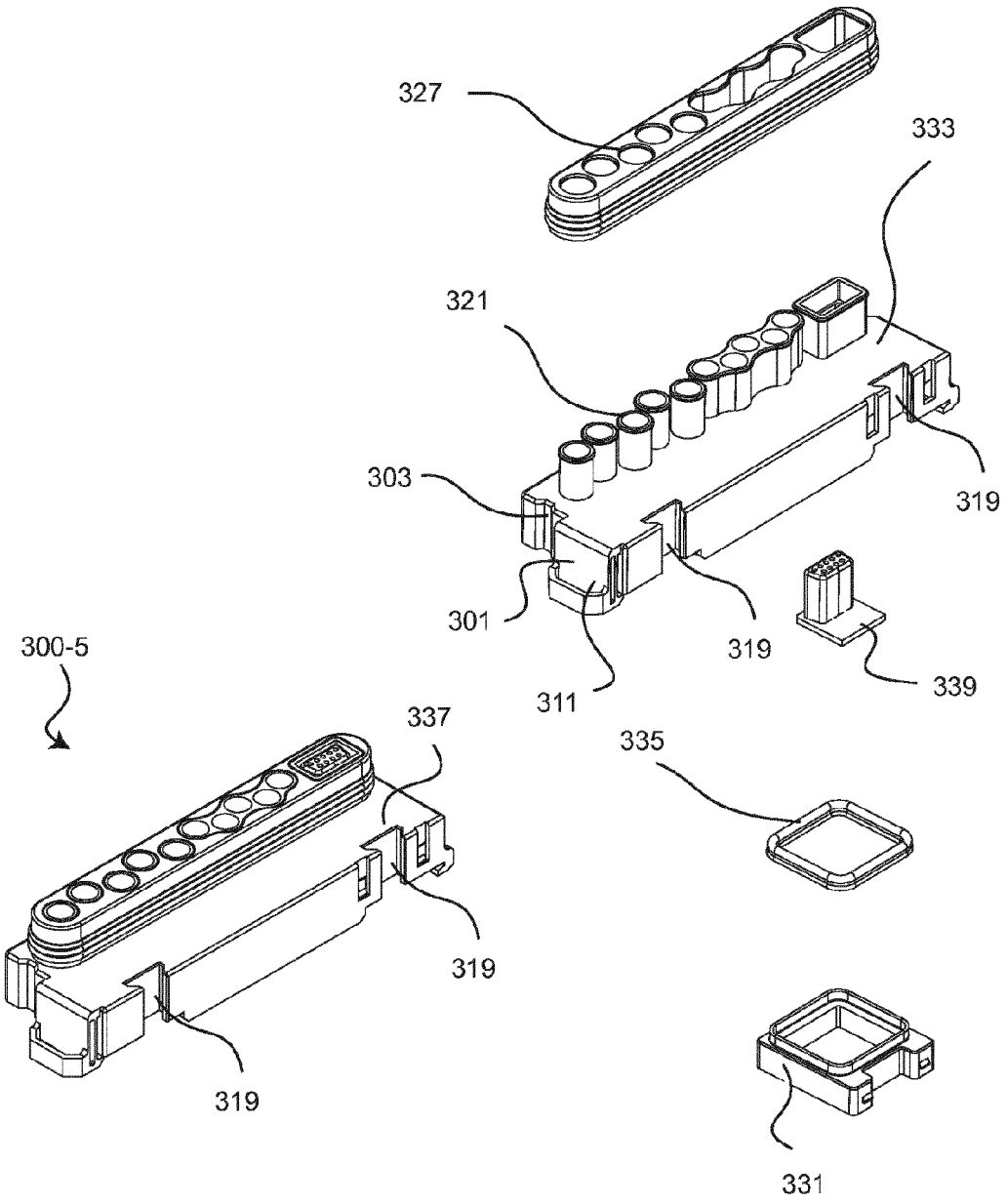
FIG. 4A shows an exploded view of a third bridging module.
Figure 4B:
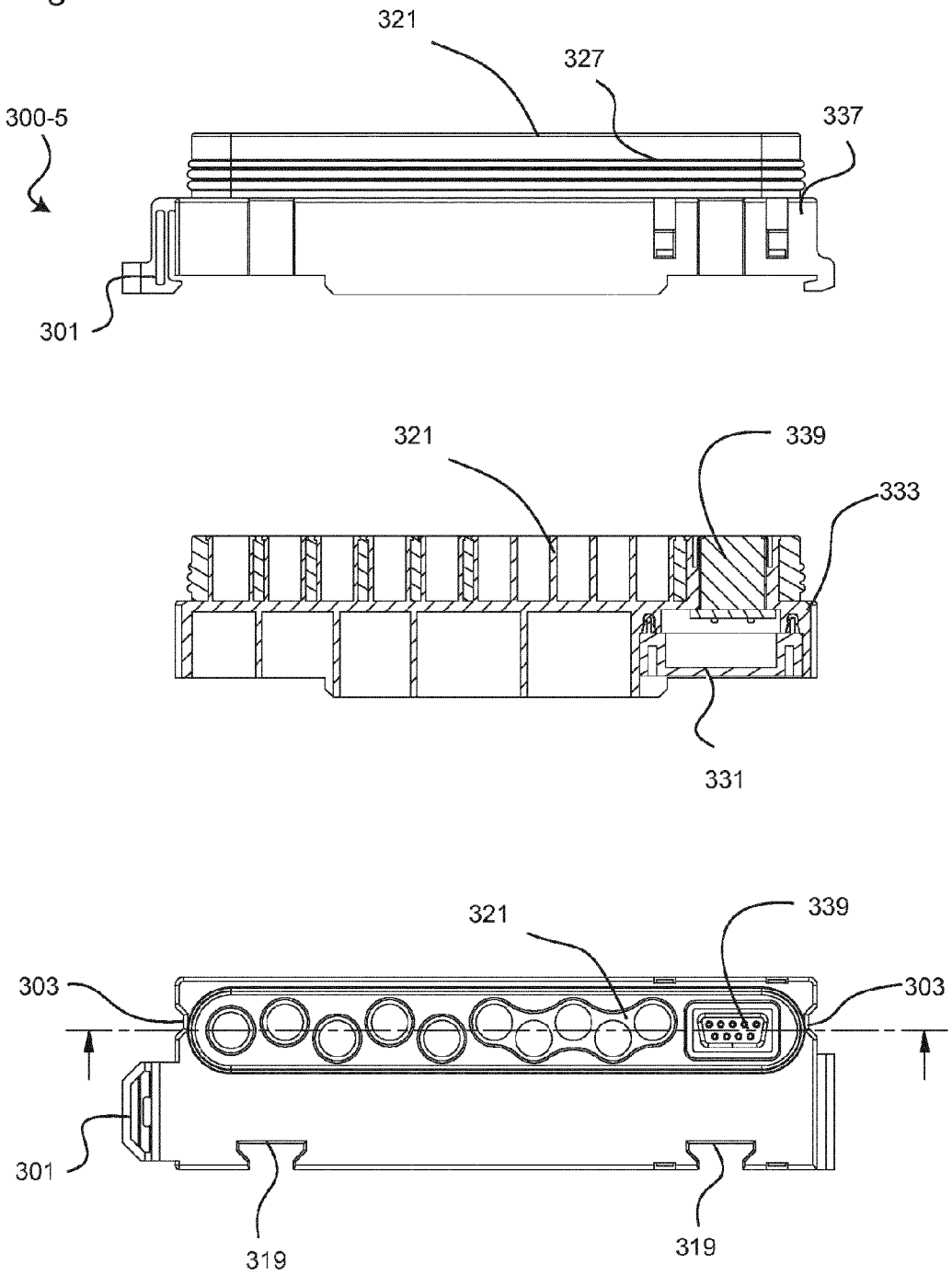
FIG. 4B shows different views of the third bridging module.

FIG. 4A shows an exploded view of a third bridging module 300-5, and FIG. 4B shows different views of the third bridging module 300-5. The third bridging module 300-5 is likewise assembled from a module housing 337 with the lower module housing part 331 and the upper module housing part 333. However, the lower module housing part 331 covers only part of the underside of the upper module housing part 333 in the area of the data bus plug 339. The bridging module 300-5 comprises a single electric plug-in section 321, which is surrounded by the sealing element 327.

Otherwise, the bridging module 300-5 corresponds to that from FIGS. 2A and 2B or from FIGS. 3A and 3B.

Figure 5A:
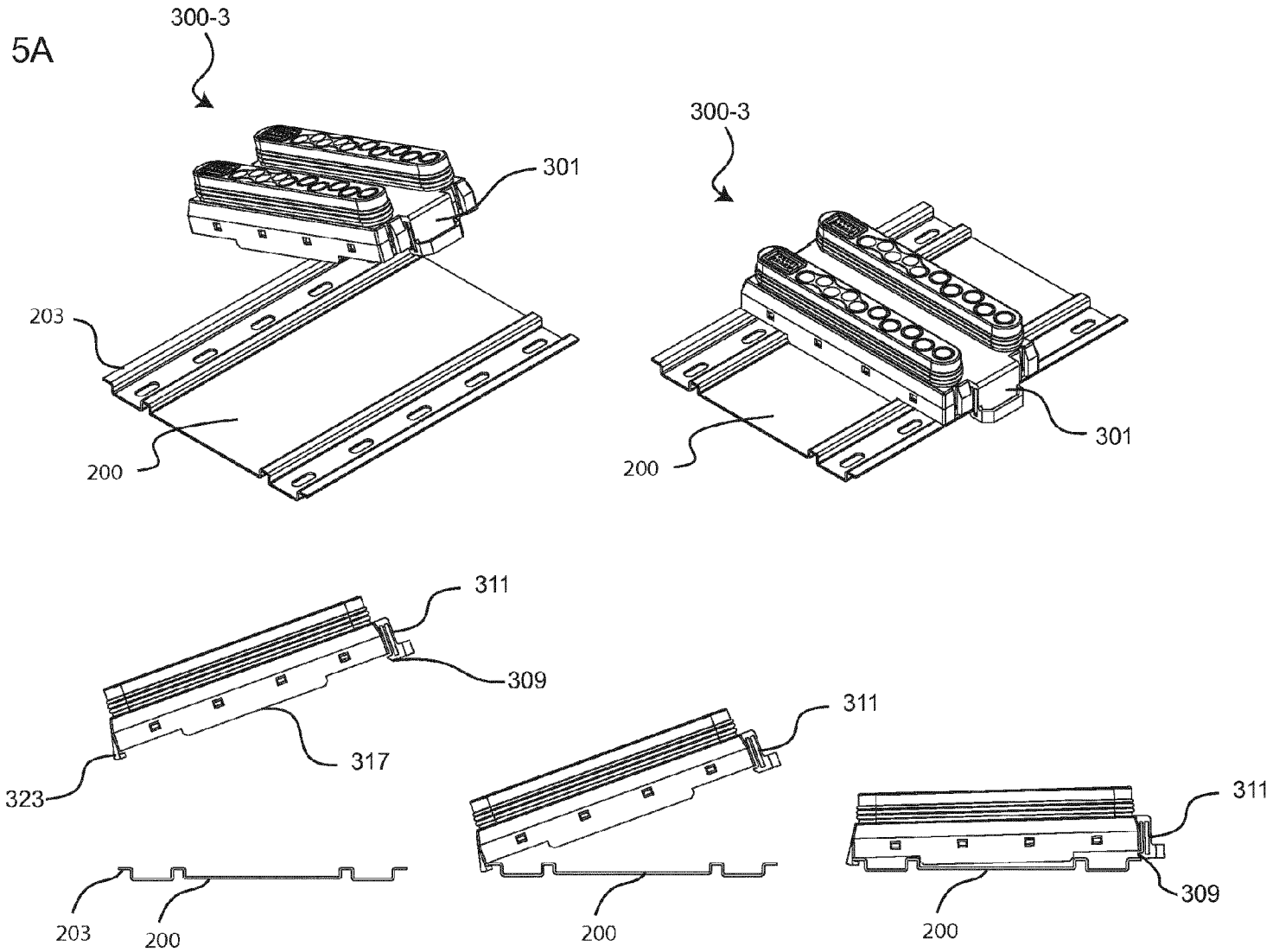
FIG. 5A shows a view of the mounting of a bridging module on a profiled mounting rail.

FIG. 5A shows a view of the mounting of a bridging module 300-3 on the profiled mounting rail 200. The latching section 311 is formed laterally in one piece on the bridging module 300-3. At the end of the latching section 311 there is a latching lug 309, such as a plastic latching hook, which, following the placement of the bridging module 300, engages behind the profiled mounting rail 200.

On the opposite side there is a rail cut-out for the insertion of an edge 203 of the profiled mounting rail 200. The rail cut-out is formed within a U-shaped placement section 323, which engages around the edge 203 of the profiled mounting rail 200 and is formed in one piece on the bridging module 300. The placement section 323 is arranged on that transverse side of the bridging module 300 which is arranged opposite the transverse side that comprises the form-fitting device 301.

The bridging module 300-3 is firstly placed with the placement section 323 on the edge 203 and then, with a rotary movement or a pivoting movement, is guided in the direction of the profiled mounting rail 200. In the process, the latching section 311 bends outward and then snaps in.

On the rear side of the bridging module 300-3 there is a projecting centering section 317, which additionally stabilizes and supports the bridging module 300 on the profiled mounting rail 200. For this purpose, the upper and lower sides of the centering section 317 each rest on the upper or lower mounting profile of the profiled mounting rail 200, so that the centering section 317 is located between the two mounting profiles of the profiled mounting rail 200.

Figure 5B:
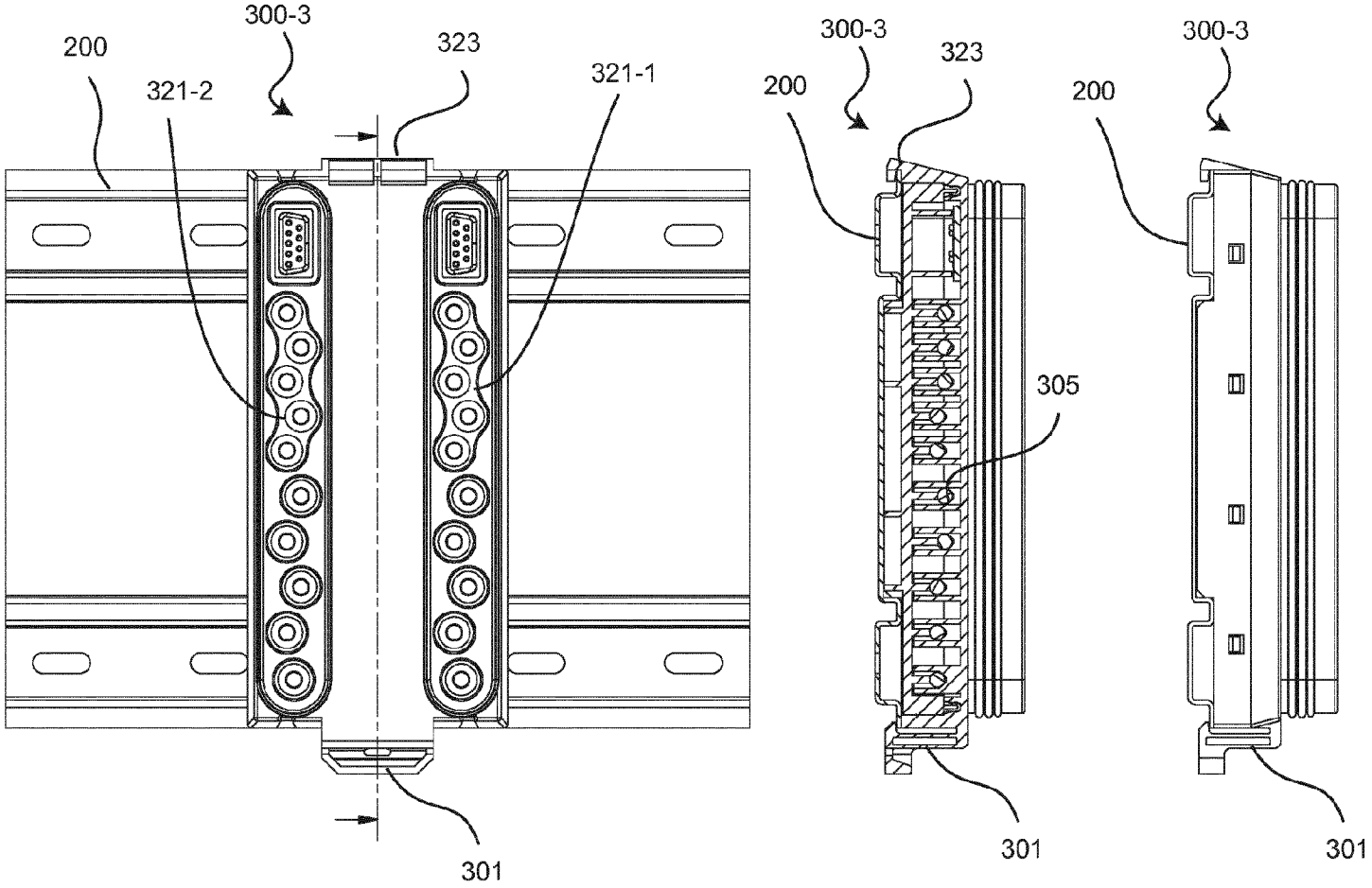
FIG. 5B shows different views of the bridging module on the mounting rail.

FIG. 5B shows different views of the bridging module 300-3 on the profiled mounting rail 200. When latched on, i.e. in the presence of a form-fitting connection, the bridging module 300-3 is displaceable laterally along the profiled mounting rail 200. As a result of the free displaceability of the bridging module 300-3, latch-free assembly on the profiled mounting rail 200 is possible but not imperative.

Following the latching or following the production of a form-fitting connection, the bridging module 300-3 is displaceable as desired on the profiled mounting rail 200 and can be used to match any desired module housing widths of the functional components. As a result, a mandatory grid can be avoided.

Figure 6A:
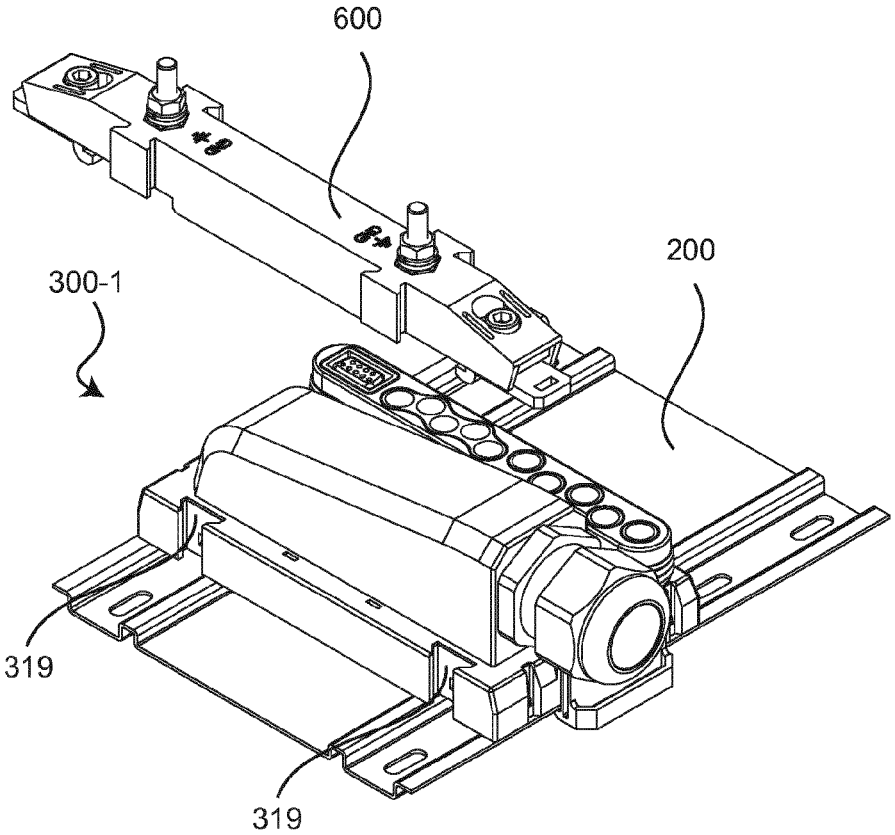
FIG. 6A shows a view of a bridging module on the profiled mounting rail.
Figure 6A:
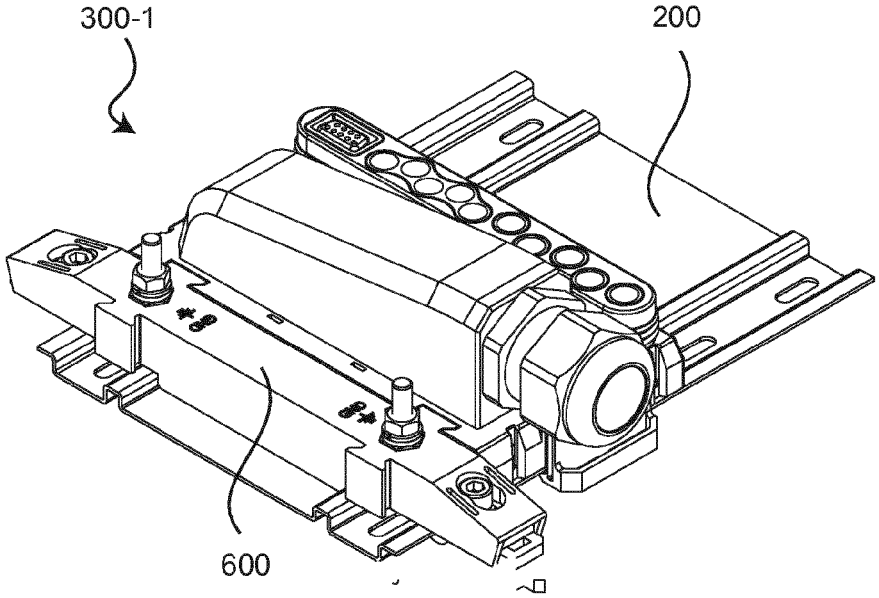

FIG. 6A shows a view of a bridging module 300-1 on the profiled mounting rail 200 together with a fixed-bearing grounding module 600. Mechanical fixing of the entire system structure along the profiled mounting rail 200, which is produced by the displaceability of the bridging modules 300 on the profiled mounting rail 200 itself, is done by means of the use of the fixed-bearing grounding module 600, which can be a clamping block, arranged on the right-hand side or left-hand side.

Figure 6B:
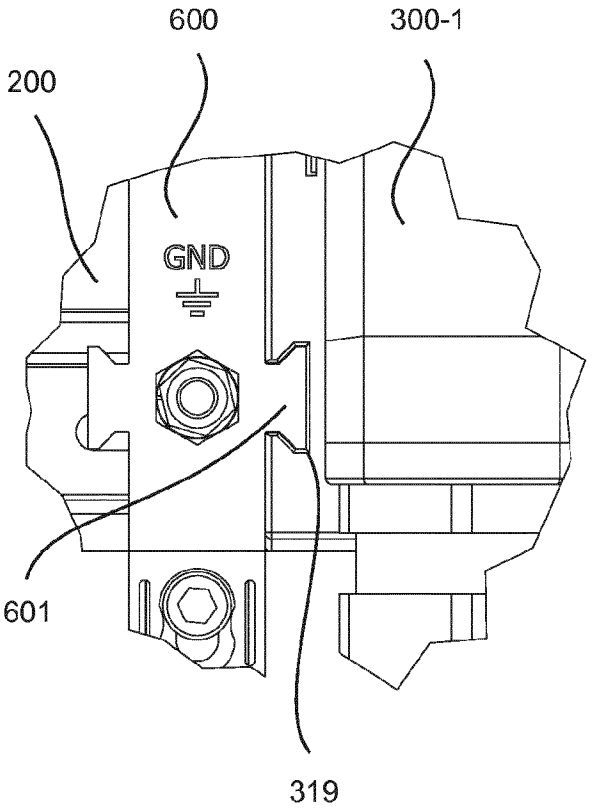
FIG. 6B shows a further view of the bridging module on the profiled mounting rail.
Figure 6B:
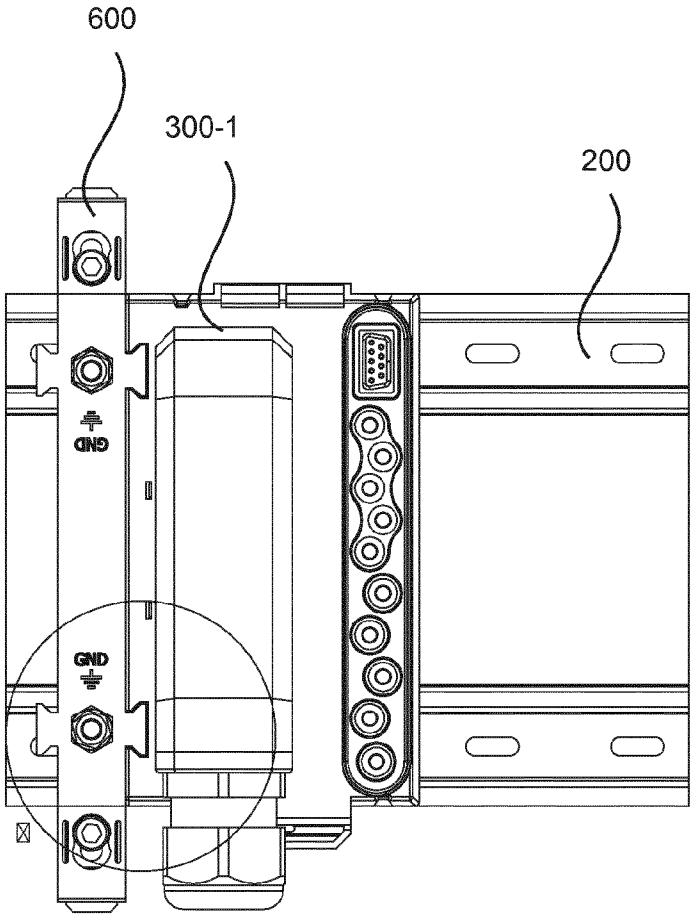

FIG. 6B shows further views of the bridging module 300-1 on the profiled mounting rail 200. The dovetail sections 601 of the fixed-bearing grounding module 600 are inserted into the dovetail cut-outs 319 in the bridging module 300-1. The fixed-bearing grounding module 600 fixes the overall system in the X direction at a fixed point on the profiled mounting rail 200. As a result of this arrangement, free breathing of the system structure in the X direction from a fixed point is possible, such as for example in the event of thermally induced longitudinal expansion. The mechanical clamping of this fixed point is at the same time the central electric grounding and connection to the profiled mounting rail of the system structure.

Figure 7:
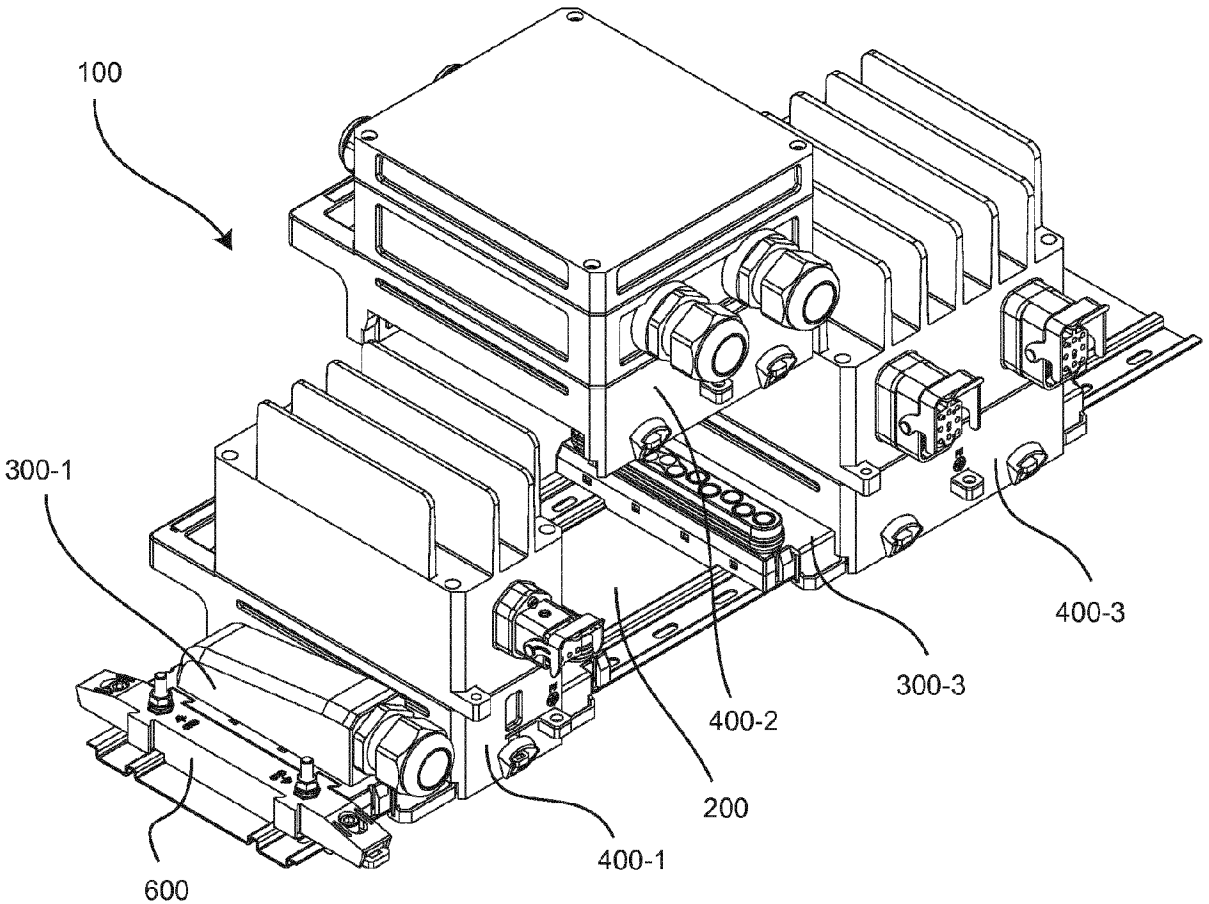
FIG. 7 shows a view of a component assembly system comprising bridging modules and functional components.

FIG. 7 shows a view of a component assembly system 100 having bridging modules 300-1 and 300-3 and functional components 400-1, 400-2 and 400-3. The component assembly system 100 is assembled from a module housing kit that can be plugged together, in which the components are latched onto a profiled mounting rail 200. The structural concept of the component assembly system 100 comprises the profiled mounting rail 200 as a mounting platform, the bridging modules 300-1 to 300-6, and the functional components 400.

The profiled mounting rail 200 forms a one-piece supporting system having a wide rail for a rack structure, which replicates the geometry of the mounting edges of the bridging modules 300-1 to 300-6 and of the functional components 400-1, 400-2 and 400-3. Alternatively, two separate standard profiled mounting rails can be used as a two-part supporting system, for example having a width of 35 mm, for a wall structure. The mounting profile can be formed by a top-hat profile.

The field stations can be used as terminal devices of a classic star distribution system by using a single feed or, by using a connector and distributor module (AV module), can become participants or nodes of a power distribution network. Switching and protective elements, motor switches, bus couplers or I/Os and so on can be arranged in a free, function-determined order on the left and right of the AV module. As a result, advantages are achieved during the engineering as a result of a visible division of extra-low and low-voltage components. A plurality of field stations as participants can cover a network of any desired structure, such as for example a line, tree or ring.

A central switch cabinet within the designed power range of the power distribution system is no longer required. By means of a suitable implementation of the associated data bus, the order and the positions of individual components of the field station can be checked for the arrangement in accordance with plan before being put into service (Remote putting into service, Remote service).

The component assembly system 100 permits the construction of "smart" installation networks for DC and AC and distribution systems without any switch cabinet in suitable plant layouts. The component assembly system can be used in the application areas of installation or power distribution. In the case of distributed automation, construction of modular field stations as functional nodes in "smart" installation networks is possible. In alternative switch cabinet concepts, construction of modular stations in the switch cabinet without bus bars and without control wiring is possible with identical project engineering for IP20 . . . IP6x.

By means of the component assembly system 100, modular motor switches can be developed in the field with a high protection class. By means of the component assembly system 100, in addition an integrated structural concept (Power & Drive, P&D) is developed which solves the task of advantageous distribution and provision of power in the field, for example outside a switch cabinet.

The modularity of the component assembly system 100 permits the expansion of the use beyond the modular field station to the "smart" power distribution as far as an alternative switch cabinet structure. In addition, coverage of the range of stand-alone functional components as terminal devices on a classic star-like power distribution system can be achieved. The component assembly system 100 permits flexible construction of modular systems in the field (IP6x) and inside or outside a switch cabinet on standard profiled mounting rails (IP20). In the case of pre-assembly, prewiring can be carried out on a mounting frame.

All the features explained and shown in conjunction with individual embodiments of the invention can be provided in different combinations in the subject matter according to the invention, in order at the same time to realize the advantageous effects thereof.

The protective scope of the present invention is given by the claims and is not restricted by the features explained in the description or shown in the figures.

LIST OF DESIGNATIONS

100 Component assembly system
200 Profiled mounting rail
203 Edge
300 Bridging module
301 Form-fitting device
303 Receiving groove
305 Bridging plug
309 Latching lug
311 Latching section
313 Recess
317 Centering section
319 Dovetail cut-out
321 Plug-in section
323 Placement section
327 Sealing element
331 Lower module housing part
333 Upper module housing part
335 Sealing element
337 Module housing
339 Data bus plug
341 Sealing screw
343 Cable receiving section
400 Functional component
600 Fixed-bearing grounding module
601 Dovetail section

The invention claimed is:

1. A bridging module electrically connectable to a functional component of a component assembly system, comprising:

a module housing which has a form-fitting device for holding the bridging module on a profiled mounting rail in a detachable and form-fitting manner, wherein the form-fitting device comprises a latching device for latching the bridging module onto the profiled mounting rail, the latching device having a resilient latching section configured to engage laterally over the profiled mounting rail, wherein the resilient latching section comprises a latching lug configured to engage behind the profiled mounting rail, wherein the resilient latching section is configured to bend outward and then snap in during placement of the bridging module on the profiled mounting rail, and wherein the bridging module comprises a projecting centering section to be located between two mounting profiles of the profiled mounting rail.

2. The bridging module as claimed in claim 1, wherein the form-fitting device is configured so as to at least partly enclose the profiled mounting rail in a form-fitting manner, or to partly engage around the same or to partly engage behind the same.

3. The bridging module as claimed in claim 1, wherein the form-fitting device comprises at least one bolt, in particular a pivotable bolt, a sliding bolt, or a latching slider for engaging underneath the profiled mounting rail.

4. The bridging module as claimed in claim 1, wherein the module housing is assembled from a lower module housing part and an upper module housing part.

5. The bridging module as claimed in claim 4, wherein a sealing element is arranged between the lower module housing part and the upper module housing part.

6. The bridging module as claimed in claim 1, wherein the module housing comprises at least one electric plug-in section for the electrical connection to the functional component.

7. The bridging module as claimed in claim 6, wherein the plug-in section comprises a sealing element for sealing the plug-in section.

8. The bridging module as claimed in claim 1, wherein the bridging module comprises a first electric plug-in section for a first functional component and a second electric plug-in section for a second functional component.

9. The bridging module as claimed in claim 8, wherein the first electric plug-in section and the second electric plug-in section are electrically conductively connected, in particular to at least one bridging plug or a crimped-on cable.

10. The bridging module as claimed in claim 1, which is configured for the transmission or distribution or branching of data and/or of power supply signals, in particular power supply signals in the low-voltage range and/or in the extra-low voltage range.

11. The bridging module as claimed in claim 10, having an active data bus connection, in particular a field bus connection, for the transmission or distribution or branching of data.

12. The bridging module as claimed in claim 1, wherein the module housing comprises a cable receiving section for the insertion of an electric cable.

13. The bridging module as claimed in claim 1, wherein the bridging module comprises a connecting point, in particular a dovetail cut-out or a T-groove/tongue cut-out or a screw fixing, for a form-fitting or for a force-fitting connection to a fixed bearing module.

14. The bridging module as claimed in claim 1, wherein the bridging module comprises at least one receiving groove for the insertion of an insert section of a functional component, in order to absorb tensile forces from the functional component along the profiled mounting rail.

* * * * *